United States Patent [19]

Hatten

[11] Patent Number: 4,685,895

[45] Date of Patent: Aug. 11, 1987

[54] STABILIZER MECHANISM FOR USE IN DRILLING DEVIATED WELL BORES

[75] Inventor: James L. Hatten, Houston, Tex.

[73] Assignee: Texas Eastern Drilling Systems, Inc., Houston, Tex.

[21] Appl. No.: 823,090

[22] Filed: Jan. 27, 1986

Related U.S. Application Data

[63] Continuation of Ser. No. 571,704, Jan. 18, 1984, abandoned, which is a continuation of Ser. No. 232,147, Feb. 6, 1981, abandoned.

[51] Int. Cl.[4] ..... E21B 17/10; E21B 17/20

[52] U.S. Cl. ..... 464/19; 175/325

[58] Field of Search ..... 175/73, 79, 80, 81, 175/82, 83, 320, 325, 326; 308/4 A; 464/18, 19, 149, 179, 183

[56] References Cited

U.S. PATENT DOCUMENTS

| | | | |
|---|---|---|---|
| 1,701,427 | 2/1929 | Shields | 175/325 X |
| 2,634,097 | 4/1953 | Zublin | 175/325 X |
| 2,712,436 | 7/1955 | McCune et al. | 464/19 |
| 3,042,125 | 7/1962 | Duncan | 175/325 X |
| 3,397,746 | 8/1968 | Link | 175/81 X |
| 3,419,094 | 12/1968 | Bobo | 308/4 A X |
| 3,799,279 | 3/1974 | Farris | 175/325 |
| 3,938,853 | 2/1976 | Jurgens et al. | 308/4 A |
| 3,945,446 | 3/1976 | Ostertag et al. | 175/325 X |
| 4,343,369 | 8/1982 | Lyons et al. | 464/19 X |
| 4,456,080 | 6/1984 | Holbert | 175/325 X |

FOREIGN PATENT DOCUMENTS

| | | | |
|---|---|---|---|
| 1593999 | 7/1970 | France | 175/73 |

OTHER PUBLICATIONS

"Drilco Stabilizers . . . Total Stabilization", Drilco, Div. of Smith International, Inc., publication No. 86, 5/79.

*Primary Examiner*—Daniel P. Stodola
*Attorney, Agent, or Firm*—Vinson & Elkins

[57] ABSTRACT

A stabilizing mechanism for guiding drill direction of a flexible drill string when drilling the straight portion of a deviated well bore. The stabilizing mechanism comprises a tubular mandrel adapted for connection between the flexible drill string and a drill bit. The mandrel has at least two, reduced diameter areas spaced apart and disposed axially along its length. A non-rotating type stabilizer sleeve is positioned on each of the reduced diameter areas. Bearing means is provided at each end of each of the sleeves to reduce wear. The mandrel is capable of traversing a short radius curve of a deviated well.

6 Claims, 7 Drawing Figures

STABILIZER MECHANISM FOR USE IN DRILLING DEVIATED WELL BORES

This is a continuation of application Ser. No. 571,704, filed Jan. 18, 1984, now abandoned, which was a continuation of application Ser. No. 232,147, filed Feb. 6, 1981, now abandoned.

BACKGROUND OF THE INVENTION

1. Field of the Invention

The invention is directed to a stabilizer for drilling the straight portion of a deviated well. More particularly, the invention is directed to a plurality of stabilizers mounted on a single mandrel for use with flexible drill pipe in drilling the straight portion of a deviated well.

2. Prior Art

Directional drilling has become a routine development operation throughout the world. In general, it may be defined as the art of controlling a rotary drill's directional and angular tendencies of penetrating the earth's surface to a special subsurface target. Much technology has been developed in order to insert a drill string into a deviated hole and then to drill an essentially straight bore hole deviated from the perpendicular.

One method of accomplishing this is to use flexible drill pipe which can literally bend around a short curved radius. The flexible drill pipe is capable of withstanding the compressive and rotational forces exerted in forcing the bit to drill a bore hole. Typical of the efforts to develop such flexible drill pipe is U.S. Pat. No. 2,515,366 (issued to J. A. Zublin).

In using a drill bit connected directly to such flexible drill pipe, in attempting to drill the straight portion of a deviated hole, there is a tendency for the bit to spiral in the hole, to drift from the desired azimuth, develop dog-legs and in general drill anything but a straight hole.

Over the years there has been developed a variety of stabilizers that are affixed to drill collars to aid in drilling a straight hole. Minimum bit efficiency is achieved when various arrangements of stabilizers are used in conjunction with their proper spacing from the drill bit.

A typical make up of drill bit, stabilizers and drill collars is illustrated on page 1826 of the *Composite Catalog of Oil Field Equipment and Services,* 34th Ed., Vol. 1, 1980–81. There are generally two types of stabilizers used in drilling today. There are the rotating and non-rotating types. Typical of the non-rotating type of stabilizer is that manufactured by Drilco, a division of Smith International, Inc. Their non-rotating sleeve-type stabilizer is illustrated on page 2511 of the 1980–81 *Composite Catalog.*

These stabilizers are typically used as a single unit mounted on a mandrel which is made up in the drill string just above the drill bit. It is essentially uniformly recommended that if additional stabilizers are to be used, they should be separated by a length of drill collar.

It has been found, however, that the art of stabilizers has been developed using rigid drill pipe. In fact, drilling manuals devoted to this topic speak in terms of using a "stiff bottom assembly" to resist any change in direction of a hole. Thus, operators commonly use a stiff bottom assembly with a single stabilizer positioned adjacent the bit.

This technology has been found to be totally inapplicable to flexible drill string drilling the straight section of a deviated hole.

OBJECTS OF THE INVENTION

It is an object of the invention to provide a non-rotating, sleeve-type stabilizer for use with a flexible drill pipe for drilling a deviated hole in a predetermined direction from the horizontal.

It is another object of the invention to provide a non-rotating, sleeve-type stabilizer for use with a flexible drill pipe for drilling the straight portion of a deviated hole.

It is another object of the invention to provide a non-rotating, sleeve-type multiple stabilizer with a mandrel that will traverse the short radius of a deviated hole for use with a flexible drill pipe in drilling the straight portion of the deviated hole.

It is another object of the invention to provide a bendable mandrel for a multi-sleeve, non-rotating stabilizer system that will traverse the short radius of a deviated hole.

These and other objects and features of this invention, and the advantages thereof, will be apparent from the following detailed description of the preferred embodiments of the invention when read in conjunction with the accompanying drawings.

BRIEF DESCRIPTION OF THE DRAWINGS

In the drawings, wherein like numerals indicate like parts, and wherein an illustrative embodiment of this invention is shown.

DESCRIPTION OF THE PREFERRED EMBODIMENTS

Figure 5:
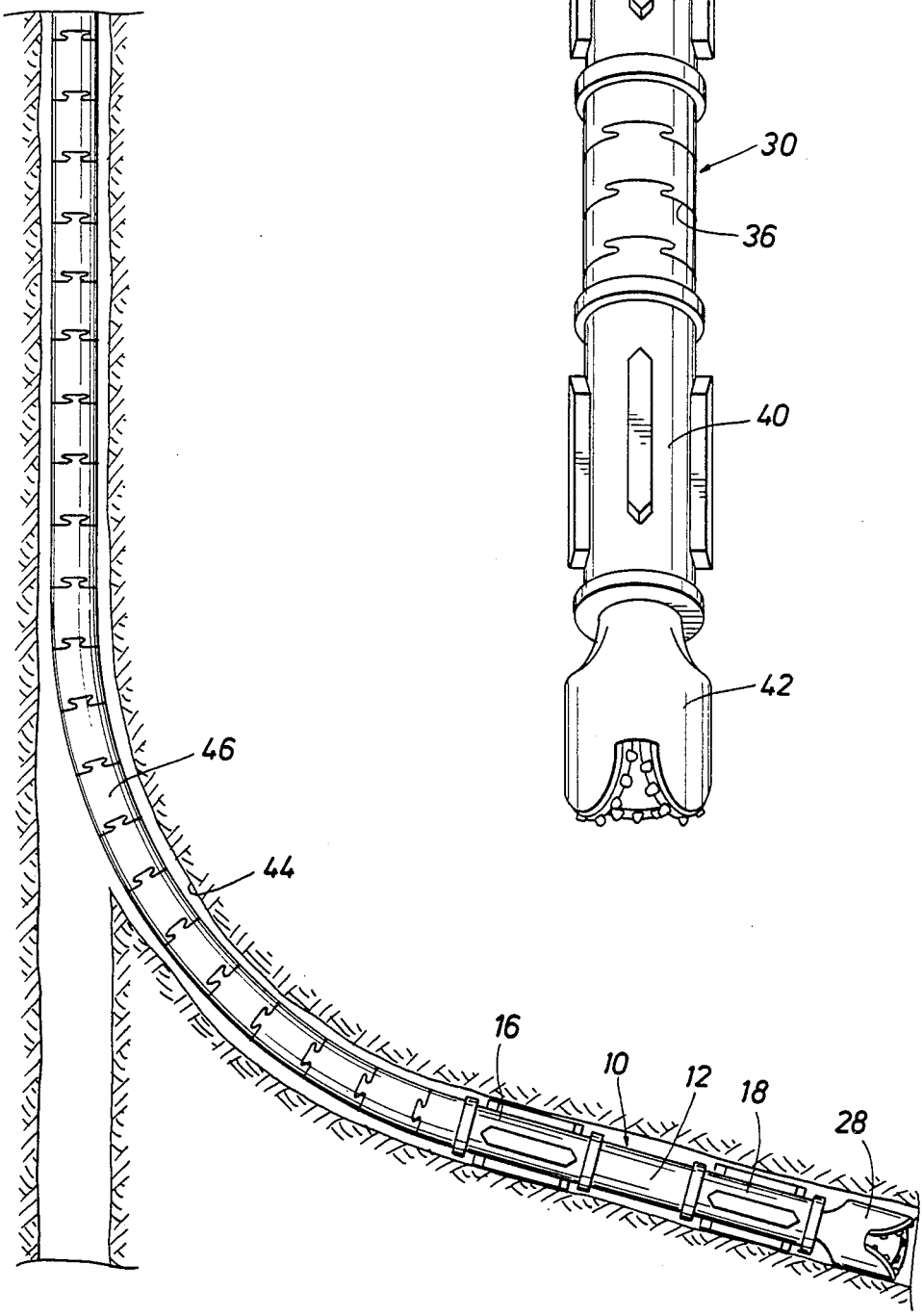
FIG. 5 is a perspective view, partially in section, of a deviated well installation having a flexible drill string, traversing the short radius of the deviated well, having one embodiment of the invention connected thereto.
Figure 6:
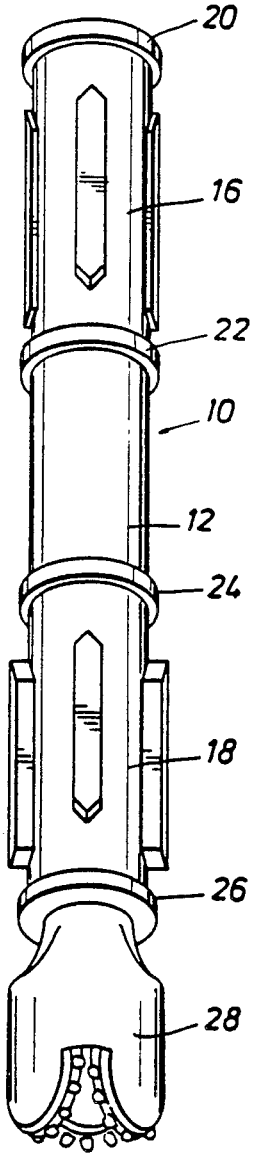
FIG. 6 is a prospective view of an alternate embodiment of the invention wherein each of the plurality of stabilizer sleeves is of a slightly smaller diameter than the preceding one, with the largest diameter stabilizer sleeve positioned adjacent the end of the tubular mandrel having means for connection of the tubular mandrel to a drill bit.
Figure 7:
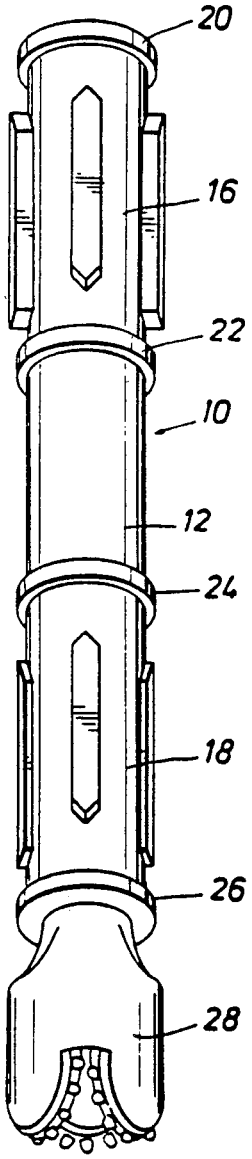
FIG. 7 is a prospective view of an alternate embodiment of the invention assembled with a drill bit connected thereto in which each of the plurality of stabilizer sleeves is of a slightly smaller diameter than the preceding one, with the largest diameter stabilizer sleeve positioned on the tubular mandrel to be most remote from the end of the mandrel having means for connection of the mandrel to a drill bit.

Referring first to FIG. 5, it can be seen that the stabilizing mechanism 10 of the present invention is useful for guiding the drilling direction of a flexible drill string 46. That is to say, the present invention is connectable to flexible drill string 46 and is adapted for connecting thereto a drill bit 28 and is capable of traversing a short radius curve 44 of a deviated well. One embodiment of the stabilizing mechanism 10 has been found to permit the drilling of an essentially straight drill path when connected to flexible drill string 46 formed of a plurality of articulated drill pipe sections. Varying the relative diameters of the stabilizer sleeves 16 and 18 permits creation of drill paths that deviate from the horizontal.

Figure 1:
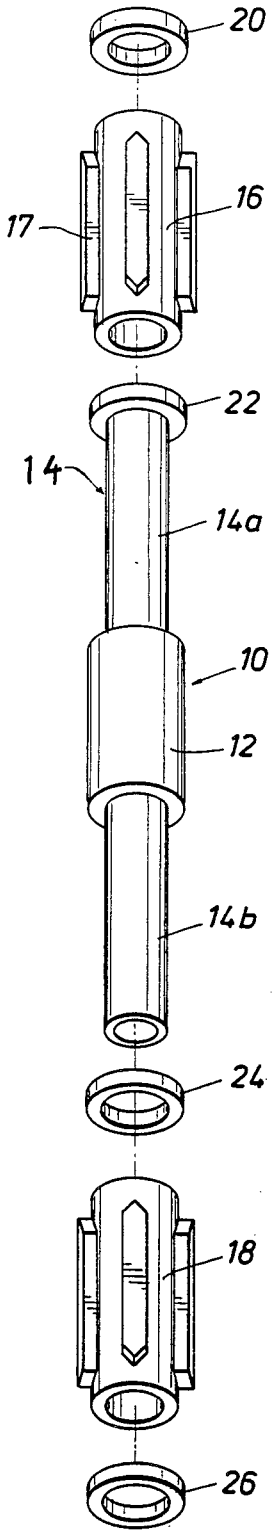
FIG. 1 is an exploded view in perspective of one embodiment of the mandrel and stabilizer system of the invention.

FIG. 1 presents an exploded view in perspective of one embodiment of the stabilizing mechanism 10 of the invention, which includes a tubular mandrel 14 having a pair of reduced diameter areas 14*a* and 14*b* forming opposed reduced diameter end sections along its length for receiving stabilizer sleeves 16 and 18. By areas for receiving the stabilizer sleeves 16 and 18 is meant that the stabilizer sleeves should preferably be separated from each other by some intermediate section or separating means 12, which can be either attached to the tubular mandrel 14 or be removable with the sleeves 16 and 18.

The separating means 12 may be welded or threaded onto the mandrel 14. Alternatively, the separating means can be just slipped on between the sleeves 16 and 18 when they are placed on the tubular mandrel 14. Another suitable method of providing separating means 12 on the mandrel 14 is to machine tubular stock to form reduced diameter areas on the mandrel 14. The tubular mandrel 14 illustrated in FIG. 1 is shown to have two areas 14*a* and 14*b* for receiving the stabilizer sleeves 16 and 18. The mandrel 14 is adapted for connection in a drill string, as discussed above.

There are provided, additionally, a plurality of stabilizer sleeves 16 and 18 which are mounted on the tubular mandrel 14. The stabilizer sleeves 16 and 18 are generally referred to as non-rotating. That is, they do not generally rotate with the mandrel 14 and drill bit 28 during drilling of the well bore. This is due to the fact that they rotate on the reduced diameter areas 14*a* and 14*b* of the mandrel 14.

A series of ribs 17 are formed on the stabilizer sleeves 16 which are oriented longitudinally along the main axis of the sleeves 16. The ribs 17 provide fluid courses allowing continuous cleaning of the cuttings in the well bore. The non-rotating sleeve-type stabilizers 16 and 18 are manufactured by a number of companies and sold world-wide. Typical of these is Drilco, whose advertisement appears at page 2511 of the *Composite Catalog*. Drilco is a division of Smith International, Inc.

Figure 2:
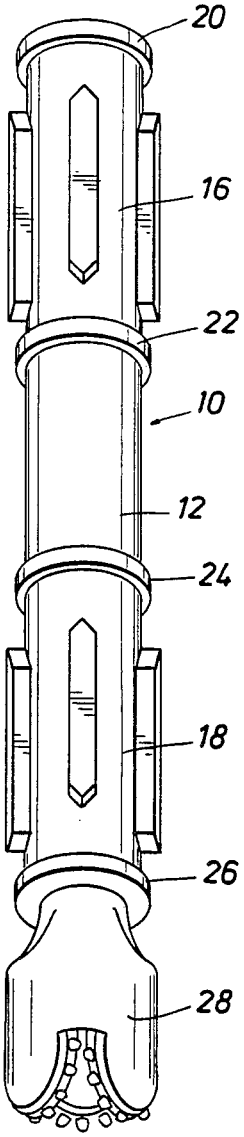
FIG. 2 is a perspective view of one embodiment of the assembled stabilizer system of the invention, showing a drill bit connected thereto.

Preferably, some bearing means 20, 22, 24 and 26 are spaced adjacent each end of the stabilizer sleeves 16 and 18. Inner bearing members 22 and 24 fit in abutting relation against separating means 12 and form abutting stops for the adjacent ends of respective stabilizer sleeves 16 and 18. Outer bearing members 20 and 26 secured to mandrel 14 after stabilizer sleeves 16 and 18 are positioned on mandrel 14 likewise form abutting stops for the adjacent ends of respective stabilizer sleeves 16 and 18 while permitting relative rotation of mandrel 14. Thus, bearing members 20, 22, 24, and 26 limit axial movement of sleeves 16 and 18 along mandrel 14. This can be seen in FIGS. 1 and 2. Preferably, the bearing means 26 positioned between the drill bit 28 and the sleeve 18 positioned next to the drill bit 28 is secured to the mandrel 14 to prevent the downhole stabilizer 18 from riding onto the bit 28 when the assembly 10 is withdrawn from the hole.

The bearing means 20, 22 and 24 are preferably manufactured from brass or steel. They should also have an inside diameter which is just slightly larger than the outside diameter of the areas 14*a* and 14*b* of the mandrel 14. As shown in the drawings and particularly FIG. 5, ribs 17 extend laterally outwardly beyond bearing members 20, 22, 24, 26 and separator 12 thereby to first engage the side wall of a bore hole and thereby space slightly the remainder of mandrel 14 from such side wall.

Figure 3:
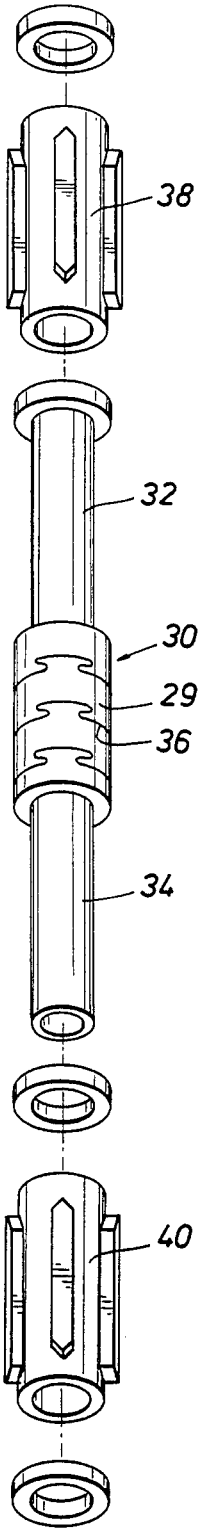
FIG. 3 is an exploded view in perspective of one embodiment of the bendable mandrel and stabilizer system of the invention.
Figure 4:
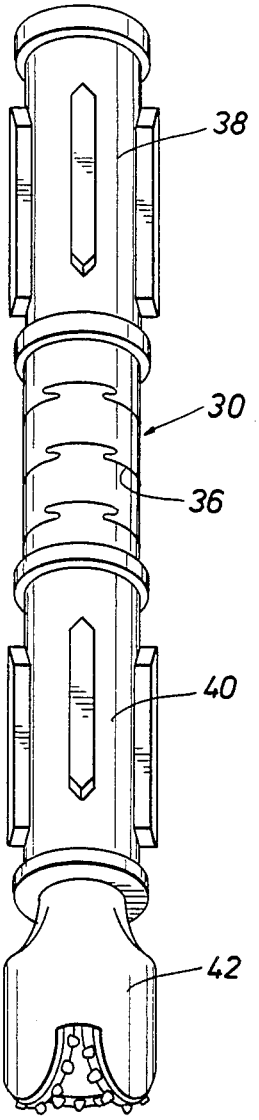
FIG. 4 is a perspective view of the embodiment of the invention of FIG. 3, assembled with a drill bit connected thereto.

In the event it is desired to form the mandrel from a stock material so that the separating means 12 is integral with the mandrel 14, the separating means 12 can be a solid unit or it can be segmented as indicated in FIGS. 3 and 4. In such embodiment areas 14*a* and 14*b* are referred to as "reduced diameter areas". As illustrated in FIG. 3, the full diameter area 29 of the mandrel 30 provides a limited radial movement means 36 such as a dovetail cut bisecting the mandrel 30 to form dovetail teeth engaged and interlocked with complementary recesses with sufficient clearance to form a joint permitting limited radial and axial movements of the bisected mandrel 30.

While this type of dovetail teeth arrangement has been known for use in drill pipe such as the flexible drill pipe of FIG. 5, it has never been used in any type of drill mandrel.

Other means may be used, however, to permit flexibility of the mandrel 30. For example, a universal joint could be used to join two sections of mandrel 30 (not shown). Limited radial flexing of the mandrel would be very useful in traversing extremely short radius curves of a deviated well. Once the mandrel 30 has traversed the short radius curve, the mandrel would tend to lie on a straight plane due to the effect of the stabilizer sleeves 38 and 40 which are fitted on the reduced diameter areas 32 and 34 of the mandrel 30. In addition, the dovetail teeth arrangement 36, particularly, allows rotative and compressive forces to be applied to the drill bit 42 connected to the mandrel 30. Preferably, the means used to impart flexibility should tend to force the mandrel into a straight plane when placed under compression forces. The dovetail cut provides this feature readily.

In a preferred embodiment of the invention, the downhole stabilizer sleeve 40 should have a smaller outside diameter than the drill bit 42 attached to the mandrel 30. The same is true of the rigid drill mandrel 10 shown in FIGS. 1 and 2. All the sleeves 16 and 18 can be either the same outside diameter size or they can be of varying sizes. Preferably, the uphole sleeve 16 is slightly smaller than the downhole sleeve 18.

For example, when using a drill bit 28 having a diameter of $6\frac{1}{4}$ inches, the downhole sleeves 18 should preferably have an outside diameter of from about $5\frac{3}{4}$ to $6\frac{1}{8}$ inches. The next sleeve back up the hole should preferably have an outside diameter of from about 5 to about 6 1/16 inches.

In another embodiment of the invention the drill bit 28 can be made to curve upward from the horizontal by reducing the diameter of the uphole sleeve 16. In like manner, increasing the diameter of the uphole sleeve 16 can tend to guide the drill bit 28 in a downward curve from the horizontal.

In one preferred embodiment of the invention, each of the stabilizer sleeves is of slightly smaller diameter than the preceding ones with the largest diameter stabilizer sleeve positioned adjacent the drill bit when the drill bit is connected to the tubular mandrel. In another preferred embodiment of the invention, with each stabilizer sleeve being slightly smaller in diameter than the preceding one, the largest diameter stabilizer sleeve is positioned on the tubular mandrel to be the most remote from the drill bit.

What is claimed is:

1. In combination with a flexible drill string structure for drilling a substantially horizontal portion of a deviated well bore including a drill string having a plurality of connected drill pipe sections and a drill bit; an improved stabilizing mechanism positioned between the drill pipe sections and said drill bit for guiding the drilling direction of said flexible drill string and permitting the traversing of a short radius curve of the deviated well bore; said stabilizing mechanism comprising:

a tubular mandrel including means for imparting limited flexibility to enable said mandrel to traverse the short radius curve of a deviated well bore and having a pair of end sections and an intermediate section between said pair of end sections;

a stabilizer sleeve mounted for relative rotative movement on each of said end sections to form spaced uphole and downhole sleeves adjacent opposed ends of said intermediate section; and cooperating means between the mandrel and sleeves to limit axial movement of said sleeves on said end sections and permit rotation of said mandrel relative to said sleeves;

the outer surface of said sleeves defining a diameter greater than the outer diameter of any portion of said intermediate section of the mandrel thereby to allow the mandrel to traverse the short radius without interference between the bore hole wall and the intermediate section; the outer diameters of the drill bit, downhole sleeve and uphole sleeve decreasing in size from the drill bit to the uphole sleeve with the downhole sleeve having an outer diameter of a size between the drill bit diameter and uphole sleeve diameter thereby to aid in controlling the trajectory of the drill bit.

2. The combination of claim 1 wherein said means for imparting limited flexibility is on said intermediate section of said mandrel to assist said mandrel in traversing the short radius curve of the deviated well bore.

3. The combination of claim 2 wherein said means for imparting limited flexibility to said mandrel comprises a dovetail cut bisecting said mandrel to form dovetail teeth engaged and interlocked with complementary recesses with sufficient clearance to form a joint permitting limited radial and axial movement of the bisected mandrel.

4. The combination of claim 1 wherein the diameter of each of said stabilizer sleeves is at least approximately one-eighth inch less than the diameter of said drill bit and the downhole stabilizer sleeve adjacent the drill bit is of a larger diameter than the uphole stabilizer sleeve adjacent the drill pipe sections.

5. A stabilizer mechanism for transversing a short radius curve of a deviated well bore having a drill bit attached to its leading end and adapted to be attached at its trailing end to a flexible drill string; said stabilizer mechanism comprising:

a tubular mandrel including means for imparting limited flexibility to enable said mandrel to traverse the short radius curve of a deviated well bore and having a pair of end sections and an intermediate section between said pair of and sections;

a stabilizer sleeve positioned for relative rotative movement on each of said end sections to form spaced uphole and downhole sleeves adjacent opposed ends of said intermediate section; and cooperating means between the mandrel and sleeves to limit axial movement of said sleeves on said end sections and permit rotation of said mandrel relative to said sleeves;

the outer surface of said sleeves defining a diameter greater than the outer diameter of any portion of said intermediate section of the mandrel thereby to allow the mandrel to traverse the short radius without interference between the bore hole wall and the intermediate section; the outer diameters of the drill bit, downhole sleeve and uphole sleeve decreasing in size from the drill bit to the uphole sleeve with the downhole sleeve having an outer diameter of a size between the drill bit diameter and uphole sleeve diameter thereby to aid in controlling trajectory of the drill bit.

6. The stabilizer mechanism as set forth in claim 5 wherein the diameter of the downhole stabilizer sleeve is at least approximately one-eighth inch less than the diameter of said drill bit, and the diameter of the downhole stabilizer sleeve is at least around one-sixteenth inch greater than the diameter of said uphole stabilizer sleeve.

* * * * *